United States Patent [19]

Schloemer et al.

[11] 4,399,641

[45] Aug. 23, 1983

[54] SYNTHETIC RESIN GLASS INSULATING PANE

[75] Inventors: Gerhard Schloemer; Klaus Steinweg, both of Lüdenscheid, Fed. Rep. of Germany

[73] Assignee: Firma Gerhardi & Cie, Fed. Rep. of Germany

[21] Appl. No.: 179,648

[22] Filed: Aug. 20, 1980

[30] Foreign Application Priority Data

Sep. 1, 1979 [DE] Fed. Rep. of Germany ..... 2935456

[51] Int. Cl.[3] ..... E04C 2/54

[52] U.S. Cl. ..... 52/309.1; 52/790; 52/808; 428/120; 428/178

[58] Field of Search ..... 52/788, 790, 808, 309.1, 52/289; 428/120, 178

[56] References Cited

U.S. PATENT DOCUMENTS

| | | | |
|---|---|---|---|
| 3,024,880 | 3/1962 | Burmeister | 52/788 X |
| 3,276,177 | 10/1966 | Keller | 52/793 X |
| 3,391,511 | 7/1968 | Harris et al. | 52/808 X |
| 4,035,539 | 7/1977 | Luboshez | 52/790 X |

FOREIGN PATENT DOCUMENTS

| | | | |
|---|---|---|---|
| 1906991 | 9/1969 | Fed. Rep. of Germany . | |
| 2005957 | 9/1970 | Fed. Rep. of Germany . | |
| 1921624 | 11/1970 | Fed. Rep. of Germany . | |
| 7833940 | 2/1979 | Fed. Rep. of Germany . | |
| 407491 | 8/1966 | Switzerland . | |
| 485092 | 3/1970 | Switzerland . | |
| 609852 | 6/1978 | U.S.S.R. | 52/808 |

*Primary Examiner*—Carl D. Friedman

*Attorney, Agent, or Firm*—Bacon & Thomas

[57] ABSTRACT

A synthetic resin glass insulating pane of, at least, two plates and web frames between the plates, the web edges thereof being welded with the plates. The web frames are provided substantially as tubular bodies. The face edges of the web frames possess outwardly projecting edge shoulders with ultrasonics aligning webs protruding vertically in regard to the face. The side walls of the web frames form the lateral surfaces of a double frustum, the two frusta of which being composed with the smaller faces. The tubes may be straight or inclined tubes and may be of any cross-section. The web frames and/or the plates may be completely and/or partly transparent or non-transparent.

11 Claims, 9 Drawing Figures

SYNTHETIC RESIN GLASS INSULATING PANE

DESCRIPTION

Figure 1:
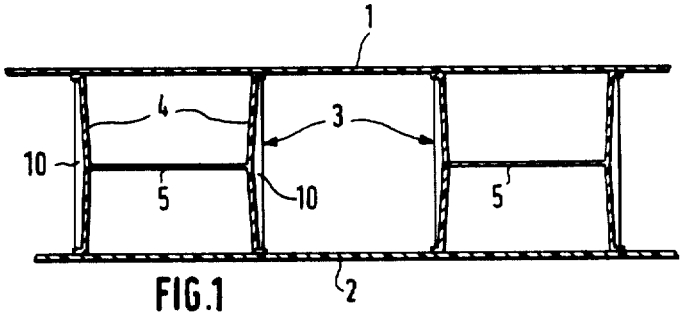

The invention relates to a synthetic resin glass insulating pane consisting of, at least, two plates and web frames between the plates, the web edges thereof being welded with the plates.

Synthetic resin glass insulating panes having webs extending in one direction (the extrusion direction) are known. Such a synthetic resin glass insulating pane has different moments of resistance in the longitudinal direction and in the transverse direction of the webs. The synthetic resin glass insulating pane requires a comparatively large wall thickness. In addition, the heat transition coefficient is comparatively high, because of the chimney-like air chambers.

An object of the invention is the provision of a synthetic resin glass insulating pane which, with a small wall thickness of the individual plates, has a uniformly high moment of resistance in all directions and a heat transition coefficient as small as possible.

In accordance with the invention this object is solved by the combination of the following features:

(a) the web frames are provided substantially as tubular bodies;

(b) the front edges of the web frames possess outwardly projecting edge shoulders with ultrasonic aligning webs, projecting vertically to the end plane;

(c) the side walls of the web frames form the side faces of a double frustum, the two cone frusta of which being put together with the smaller front faces.

The web frames fill up the intermediate space between the two plates so that the adjoining web frames form a lattice-work with continuous partition walls. The web frames are tubular bodies of any cross-section; circular cylinders, elliptical cylinders, or cylinders with polygonal cross-section, particularly cross-section of quadratic form, may be provided. The intermediate layer between the two outer plates, thus, is subdivided into a plurality of small chambers so that one obtains small air chambers and, consequently, a small heat transition coefficient. Ultrasonic aligning webs are provided to guarantee a high strength and security of the ultrasonic weld joints and a uniform connection across the whole area of the synthetic resin glass insulating pane by directing and concentrating the ultrasonic energy into the ultrasonic welding area so that this contributes to the stability of the synthetic resin glass insulating pane. The synthetic resin glass insulating pane has an equal moment of resistance in the longitudinal direction and in the transverse direction. This design with the web frames renders possible very thin wall thicknesses of less than 1 mm. Preferably the wall thickness is 0.5 mm.

The plates and web frames may consist of an impact resistant transparent synthetic material, such as polycarbonate, polyester, or polyvinyl chloride. Due to the fact that the web frames adjoin each other and form latticed supporting means in the joint area, a very good force resistant structure results so that the stability is extremely high. This is important for structural members, particularly self-supporting structural members. It is also possible to manufacture the web frames from a non-transparent material in order to alter the transparency of the synthetic resin glass insulating pane.

As a further development of the invention the web frames possess a polygonal shape, and, at least, in each corner range there are provided reinforcement webs with a straight front edge. As a further development of the invention it is provided that the web frames have a square shape, and that in the joint range the edge shoulders are cut off on a line, vertically aligned to the diagonal, at the height of the face edge of the specific reinforcement web. Thereby one achieves a particularly uniform and stable design.

As a further development of the invention it is provided that on the side walls there are provided further reinforcement webs. Thereby the stability of the web frames is increased.

In accordance with a further configuration of the invention it is provided that about halfway in regard to each web frame at the level of the contraction of a double truncated pyramid shape there is moulded in an intermediate plate. By this provision the invention provides a triple pane having an extremely high heat insulation.

As a further development of the invention, it is proposed that, on a side wall of the web frame, there is moulded on a tongue-shaped plate, the size of which being equal to about the size of the face of the web frame. By this arrangement, the artificial material insulating glass pane comprises an intermediate plate across its whole area.

Finally, it is proposed by the invention that the remaining three side walls of the web frame comprise groove ledges for the reception of the tongue-shaped plate. Consequently, the edges of the tongue-shaped plate are guided and held so that the bond of the synthetic resin glass insulating pane is very good across its total area. In order that the synthetic resin glass insulating pane excludes a direct incidence of the solar radiation or of any other radiation, it is proposed by the invention that the web frames comprise a slant tubular shape, the axis being inclined in regard to the faces. Then it is necessary to align the synthetic resin glass insulating pane at the installation in such a manner that the incline of the tubular axis is aligned opposite the direction of incidence of the solar radiation. Then a glare-free lighting is secured. The height and incline of the web frames must be determined in such a manner that a direct passafe of light radiation is not possible. The anti-glare effect is guaranteed particularly in such a case if the web frames are of a non-transparent substance.

In accordance with a further feature of the invention, it is provided that the plates are provided as transparent plates, and that the web frames are provided as opaque or non-transparent web frames. Moreover, it is proposed by the invention that the upper plate is provided completely or partly as an opaque or non-transparent plate and covers the openings of the web frames in such a manner that a direct light transmission is not possible.

By the last-mentioned developments it is rendered possible that the synthetic resin glass insulating pane may be adapted to different applications.

Figure 2:
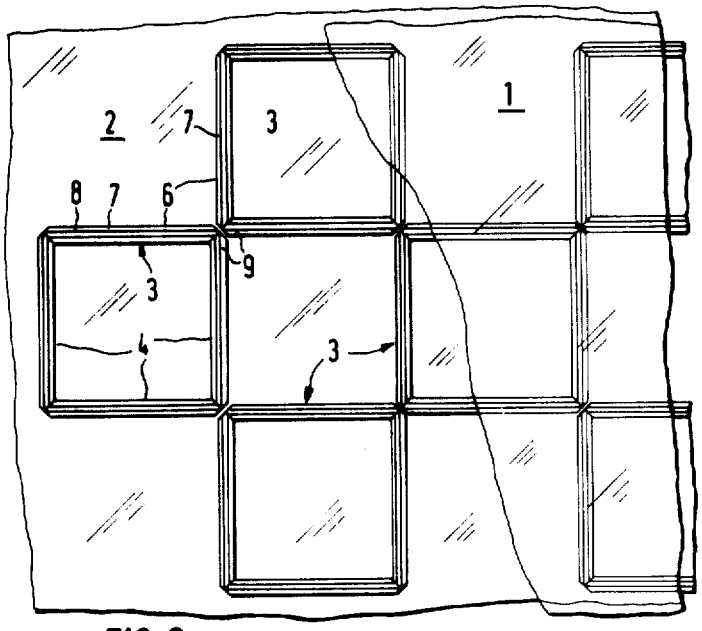
Figure 3:
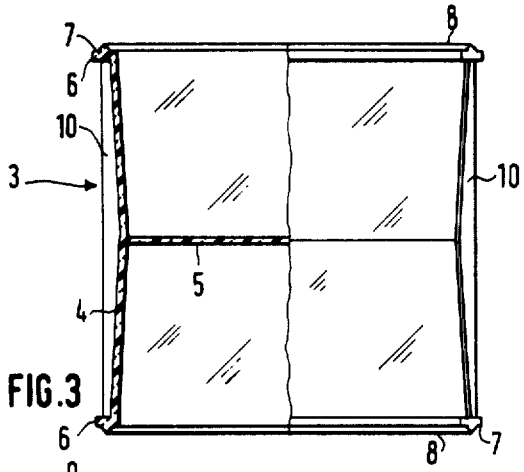
Figure 4:
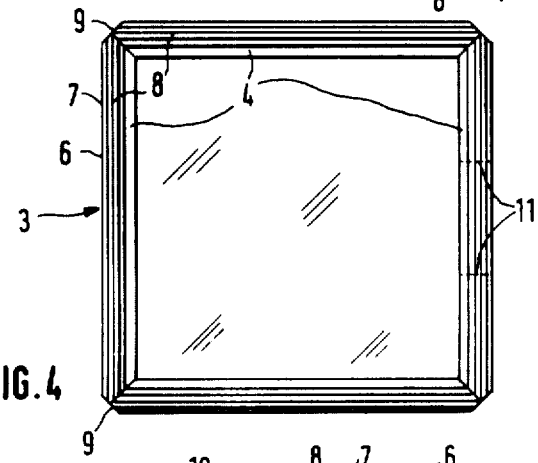
Figure 5:
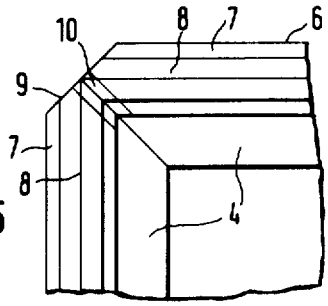
Figure 6:
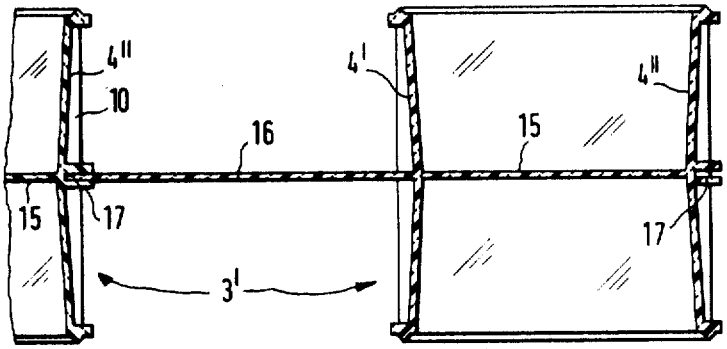
Figure 7:
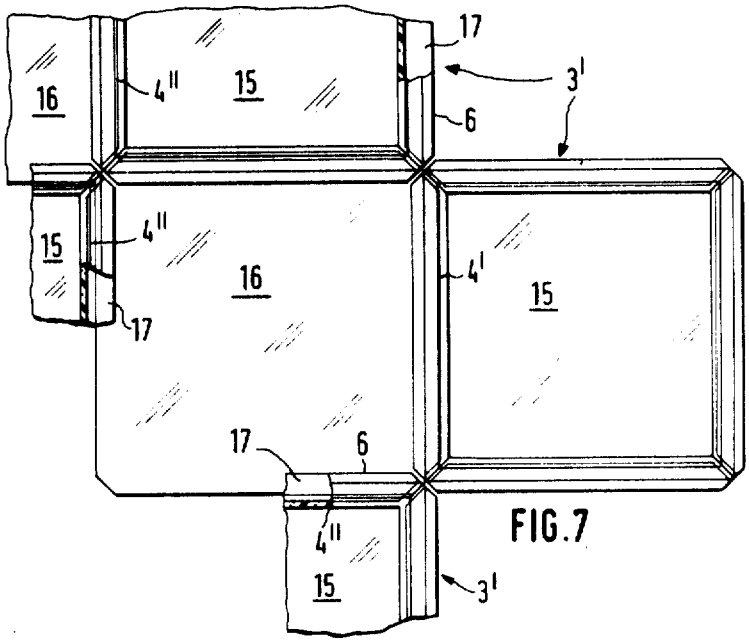
Figure 8:
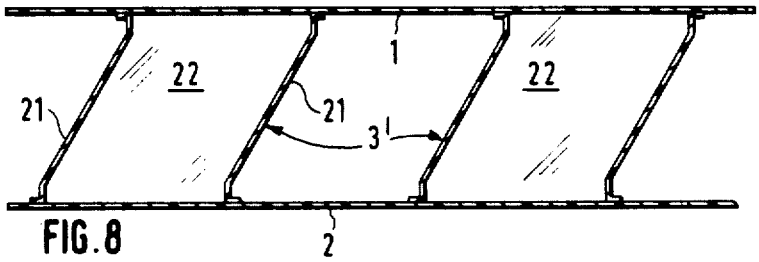
Figure 9:
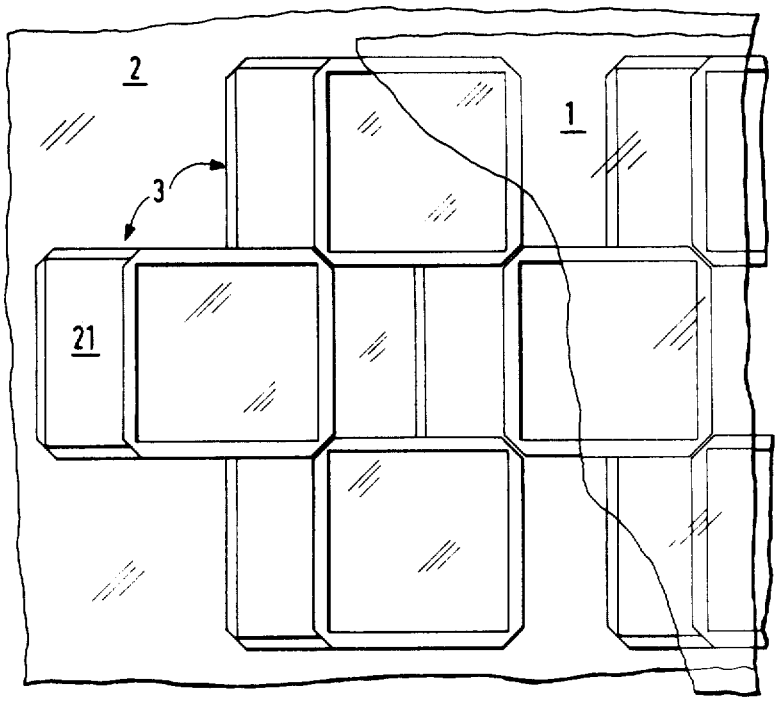

Embodiments of the invention will be described in the following with reference to the attached drawings, wherein:

FIG. 1 is a part-section, on an enlarged scale, through a synthetic resin glass insulating pane, FIG. 2 is a plan view in regard to FIG. 1, FIG. 3 is a sectional, half of it, single-view of a web frame, on a further enlarged scale, FIG. 4 is a plan view in regard to FIG. 3, FIG. 5 shows a corner section of the web frame as a plan view, on a further enlarged scale, FIG. 6 is a section through a modified embodiment of web frames for a triple insulating pane, FIG. 7 is a plan view in regard to FIG. 6, FIG. 8 is a modified embodiment with web frames in the form of slant cylinders, whilst FIG. 9 shows a partly broken plan view in regard to FIG. 8.

The section through the insulating pane according to FIG. 1 shows an upper plate 1 and a lower plate 2, with web frames 3 being arranged between them. All parts consist of polycarbonate material. The plates may comprise a wall thickness, adapted to the specific load relations and conditions. The wall thickness of the plates may be reduced to 0.5 mm, or less.

First of all, the structure of a web frame will be described with reference to FIGS. 3 to 5. Each web frame in a plastic injection moulded part in tubular shape. The web frame as illustrated is a tubular having a substantially square cross-section, and it comprises four side walls 4 which are inclined in regard to one another in such a manner that they form the side faces of a double frustum having a contraction 5 equidistant between the ends of the web frame 3. The frustum has a substantially square cross-section. At the open faces there are provided peripheral face edges 6 having an enlarged contact surface 7. Within this contact surface 7 there are provided ultrasonics aligning webs 8. A joint is formed at the the corner range defined by the intersection of the edge shoulders. The corner range is formed where the edge shoulders are cut off each along a line 9 which is oriented vertically to the diagonal of the web frame 3 and the face edge 6. In addition, at least, in the corner range, there are provided reinforcement webs 10, the face edges of which are aligned vertically to the faces of the web frames 3 and each is bounded, at one end, by the cut off line 9.

For the complete synthetic resin glass insulating pane, web frames 3 are put together into a plane-covering pattern, two adjacent web frames 3 each contacting with the diagonally cut off lines 9. Consequently, the web frames 3, according to FIG. 2, form a chequered pattern. On both front sides of the web frames 3, there are arranged plates 1 and 2. An areal ultrasonic welding (sealing) is effected so that the face edges 6 are in firm connection with plates 1 and 2, as shown in FIGS. 1 and 2. The ultrasonic aligning webs 8 serve for the orientation and guidance of the ultrasonic energy. The ultrasonic sealing may be carried out in a suitable manner, e.g., by continuous guidance of the arrangement between ultrasonic welding heads. The finished insulating pane contains, in each case about cuboid regions which, on the one hand, are closed by the inner space of a web frame and, on the other hand, by four side walls of four abutting web frames. These enclosed spaces form air cushions so that one obtains very favourable values for the heat transition coefficient. By the enclosed spaces between the two plates 1 and 2 an air circulation between these plates 1 and 2 is not possible. As already mentioned, the plates and web frames consist of polycarbonate material and the wall thickness of the plates is 0.5 mm each. The distance of the plates 1 and 2 is 40 mm. Also the edge length of a face edge 6 is 40 mm. Measurements showed a heat transition coefficient of 2.7 (Watt/$m^2$k) for such a synthetic resin glass insulating pane.

In case of need, it is possible to arrange additional reinforcement webs 10' distributed over the walls 4, as this is indicated by broken lines 11 in the right half of FIG. 4.

FIGS. 6 and 7 show a modified embodiment of the invention, namely, a triple insulating glass pane. The web frames 3' correspond to the web frames 3 with the modification that there is moulded in an intermediate plate 15 at the level of the contraction 5 and, in addition, upon a side wall 4', there is moulded on a tongue-shaped plate 16, the size of which approximately corresponding with the size of the face of the web frame 3'. At the remaining side walls 4'', at the level of the contraction 5, there are moulded on groove ledges, within which the tongue-shaped plates 16 of adjacent web frames 3' are received.

The holding together of this synthetic resin glass triple insulating pane is easily evident from FIGS. 6 and 7. The web frames 3' are put together in such a manner that in each case a tongue-shaped plate 16 of a web frame 3' is received with its three free edges in groove ledges 17 of three adjacent web frames 3'. The free faces of the web frames 3' are covered by plates 1, 2 which are to be welded with the web frames in the manner as described above with regard to FIG. 2. Thus, one obtains a synthetic resin glass triple insulating pane with a continuous intermediate plate at half the height which is formed by the tongue-shaped plates 16 and by the intermediate plates 15. By this, the heat transition coefficient is further reduced. The web frames as illustrated are tubes having a substantially square cross-section in contact with the plates. It is also possible to provide tubes having any other cross-sections, for example, a polygonal cross-section, a circular cross-section, and the like. The web frames as illustrated up to now are straight tubes each. FIGS. 8 and 9 show modified embodiment, according to which the web frames 3' are provided as slant or oblique tubes having a square cross-section. The two side walls 21 are inclined to the front surfaces, and the side walls 22 have parallelogram shape. All web frames 3' are arranged with the same incline of the side walls 21, as can be seen from FIGS. 8 and 9. The upper plate 1 and the lower plate 2 are positioned as previously described. The web frames 3' consist of particularly a rather non-transparent or opaque material. Such a synthetic resin glass insulating pane is orientated in such a manner that the incline of the lateral face 21 is orientated against the light incident direction. Thus, an immediate light passage is avoided to provide glare free lighting. The height of the web frame 3' and the incline of the side walls 21 must be dimensioned as a function of the position of the expected position of the sun.

The light incidence conditions and the transparency of the synthetic resin glass insulating pane may be influenced in still another way. It is possible to provide the intermediate plates 15 and the tongue-shaped plates 16 as illustrated in FIGS. 6 and 7 in such a manner that merely a part of the free openings is covered. Then the synthetic resin glass insulating pane is oriented in such a manner that light passing through this intermediate plate or tongue-shaped plate is shielded.

Furthermore, the invention provides that the plates are made as clear as glass, and that the web frames are made as opaque or non-transparent web frames. In the alternative, it is provided by the invention that the upper plate is provided completely or partly as an opaque or non-transparent plate and covers the openings of the web frames in such a manner that a direct light transmission is not possible. In the case of the last described embodiment one may provide for the non-transparency of the upper plate by a imprint on the plate, or in any other manner.

We claim:

1. A synthetic resin glass insulating pane, consisting of at least two plates with web frames between the plates, edges of the web frames welded with the plates, characterized by:

(a) the web frames are provided as substantially tubular bodies;

(b) at least one edge of the web frames are provided with outwardly projecting edge shoulders and, integral therewith, ultrasonic aligning webs project vertically and contact said plates; and, (c) side walls of the web frames form side faces of a double frustum.

2. A synthetic resin glass insulating pane according to claim 1, characterized in that the web frames have a polygonal shape, and that reinforcement webs, are provided for at least each corner area of said web frames.

3. Synthetic resin glass insulating pane according to claim 2, characterized in that the web frames, have a substantially square cross-section in contact with said plates, and that in a corner range the edge shoulders are cut off each on a line, vertically aligned to the diagonal.

4. Synthetic resin glass insulating pane according to one of claims 1, 2, or 3, characterized in that on the side walls there are provided further reinforcement webs (11).

5. Synthetic resin glass insulating pane according to claim 4, characterized in that each web frame at the level of a contraction of the double frustum there is moulded an intermediate plate at a midpoint of the contraction.

6. A synthetic resin glass insulating pane according to claim 5, characterized in that, on at least one side wall of the web frame, there is molded a tongue-shaped plate.

7. Synthetic resin glass insulating pane according to claim 6, characterized in that remaining three side walls (4') of the web frame (3') comprise groove ledges (17) for the reception of the tongue-shaped plate (16).

8. Synthetic resin glass insulating pane according to claim 7, characterized in that the synthetic resin glass insulating pane consists of an impact-resistance transparent synthetic material.

9. Synthetic resin glass insulating pane according to claim 8, characterized in that the web frames comprise an inclined tubular-shape, the axis being slant in regard to the faces.

10. Synthetic resin glass insulating pane according to claim 9, characterized in that the plates are provided as transparent plates, the web frames are provided as opaque or non-transparent web frames.

11. Synthetic resin glass insulating pane according to claim 10, characterized in that the upper plate is provided completely or partly as an opaque or non-transparent plate and covers the web frames in such a manner that a direct light transmission is not possible.

* * * * *